US008333379B2

(12) United States Patent
Gough

(10) Patent No.: US 8,333,379 B2
(45) Date of Patent: Dec. 18, 2012

(54) METHOD OF ADMINISTERING A GREETING CARD AND LOTTERY GAME COMBINATION

(76) Inventor: Joseph William Gough, Whitmore Lake, MI (US)

( * ) Notice: Subject to any disclaimer, the term of this patent is extended or adjusted under 35 U.S.C. 154(b) by 635 days.

(21) Appl. No.: 12/171,476

(22) Filed: Jul. 11, 2008

(65) Prior Publication Data

US 2009/0014951 A1 Jan. 15, 2009

Related U.S. Application Data

(60) Provisional application No. 60/949,048, filed on Jul. 11, 2007, provisional application No. 60/974,114, filed on Sep. 21, 2007, provisional application No. 61/046,150, filed on Apr. 18, 2008.

(51) Int. Cl.
*A63F 3/06* (2006.01)

(52) U.S. Cl. ..... 273/138.1

(58) Field of Classification Search ..... 273/138.1
See application file for complete search history.

(56) References Cited

U.S. PATENT DOCUMENTS

| | | | | |
|---|---|---|---|---|
| 5,303,487 | A | 4/1994 | Olson | |
| 5,513,117 | A * | 4/1996 | Small | 700/233 |
| 5,761,836 | A | 6/1998 | Dawson | |
| 6,965,447 | B2 | 11/2005 | Satake et al. | |
| 6,965,912 | B2 | 11/2005 | Friedman et al. | |
| 7,128,261 | B1 | 10/2006 | Henderson et al. | |
| 2001/0054010 | A1 | 12/2001 | Bernabeo et al. | |
| 2009/0031595 | A1 * | 2/2009 | Dolan et al. | 40/124.01 |
| 2009/0165343 | A1 | 7/2009 | Miller et al. | |

FOREIGN PATENT DOCUMENTS

WO W/O 03/068528 * 8/2003

OTHER PUBLICATIONS

International Search Report, PCT/US08/69791, Oct. 22, 2008, 2 pages.

Scratch Head Designs—The Way to Gift Lottery Scratch-off Tickets, http://www.scratchheaddesigns.com/, Feb. 20, 2009, 1 page.

* cited by examiner

*Primary Examiner* — Michael Dennis

(74) *Attorney, Agent, or Firm* — Howard & Howard Attorneys PLLC

(57) ABSTRACT

A method and a system for administering a greeting card and lottery game combination are provided. The method includes the step of providing the greeting card with an identifier associated therewith, which greeting card is provided at a location accessible to a consumer. A lottery game is maintained at a secure point of sale separate from the greeting card. A vendor of the lottery game obtains information from the identifier associated with the greeting card, which identifier contains sufficient information for the vendor to select the lottery game absent instruction from the consumer, and the lottery game is selected by the vendor based upon the information obtained from the identifier. The selected lottery game is provided to the consumer to produce the greeting card and lottery game combination. The combined greeting card and lottery game system comprises the greeting card and the lottery game, with the lottery game maintained separate from the greeting card.

15 Claims, 4 Drawing Sheets

METHOD OF ADMINISTERING A GREETING CARD AND LOTTERY GAME COMBINATION

RELATED APPLICATIONS

This patent application claims priority to and all advantages of U.S. Provisional Application Nos. 60/949,048, 60/974,114, and 61/046,150, filed on Jul. 11, 2007, Sep. 21, 2007, and Apr. 18, 2008, respectively.

BACKGROUND OF THE INVENTION

1. Field of the Invention

The instant invention generally relates to a method and system for administering a greeting card and lottery game combination. More specifically, the instant invention relates to a method of administering the greeting card and lottery game combination with the lottery game selected based on information obtained from the greeting card.

2. Description of the Related Art

Entities that administer lottery games, such as state governments, casinos, etc., are continually developing lottery games and marketing campaigns for lottery games to appeal to consumers and increase sales of the lottery games. For example, state lotteries periodically roll out new lottery games, themed games (such as variously-themed scratch-off lottery games), and marketing campaigns for purposes of attracting new consumers to purchase the lottery games and/or for increasing volume of sales. Thus, it stands to reason that the entities that administer lottery games continually strive to pursue opportunities that attract new consumers to and increase volume sales of the lottery games.

The greeting card industry is a multi-billion dollar industry in the United States alone, with the practice of exchanging greeting cards well-entrenched in American society for generations. Greeting cards are exchanged for various special occasions, especially for birthdays, holidays, and special events such as graduations. It has become common practice to enclose money or other objects of value, such as lottery games, in the greeting cards, and many greeting cards exist that are specially adapted for holding money or lottery games. In fact, certain greeting cards are themed in a manner that refers to the money or other object of value.

The existing practice of enclosing lottery games in the greeting cards suffers from many disadvantages. For example, combined greeting cards and lottery games are incapable of providing an integrated appearance. More specifically, lottery games are not designed to correlate to a particular greeting card design, and regardless of the detail with which greeting cards are designed to correlate to a particular lottery game, the combined greeting cards and lottery games are incapable of providing an appearance to the consumer that the combined greeting card and the lottery game are designed for each other. While greeting cards have been marketed that have a theme that generally matches the theme of a particular lottery game, there is still a disconnect relative to the particular details of the greeting cards and the details of the lottery game that is perceptible to the consumer. For example, while a holiday-themed greeting card may be marketed to correlate with a holiday-themed lottery game, that is the extent of the correlation and the details of the respective designs are not correlated. Combined greeting cards and lottery games having the disconnect between such details appear unprofessional and haphazardly prepared, which is undesirable from the standpoint of the consumer. Further, even when greeting cards are designed to correlate to a particular lottery game, the burden remains on the consumer to verify that the vendor of the greeting card has a lottery game that is appropriate for the given greeting card and to select the particular lottery game. As such, the purchase of a themed greeting card that merely generally correlates to a particular lottery game still requires a decision on the part of the consumer to select an appropriate lottery game to include with the themed greeting card.

One reason for the aforementioned disconnect is the fact that, to date, greeting card manufacturers, entities that administer lottery games, and vendors of the greeting cards and lottery games have not collaborated to create a combined greeting card and a lottery game that can achieve an integrated appearance. Due to the secure nature of lottery games and the care that must be taken to avoid compromising the security of the lottery games, entities that administer lottery games have avoided creating combined greeting card and lottery games themselves that are integrated prior to sale. Because such a combined greeting card and lottery game would have to remain under tight control at all times prior to sale, there is no way to make the combined greeting card and lottery game seamlessly accessible to the consumer such that the consumer would not have to change purchasing habits for purposes of selecting the combined greeting card and lottery game. For example, the combined greeting card and lottery game would have to be maintained at a point of sale, with the combined greeting card and lottery game displayed apart from a customary greeting card display location with conventional greeting cards. Alternatively, a dummy greeting card and lottery game would have to be provided at the customary greeting card display location with the conventional greeting cards, with the consumer required to request a valid combined greeting card and lottery game at the point of sale.

Another disadvantage of the existing practice of enclosing lottery games in greeting cards is that the selection of a lottery game to include in a greeting card places an added burden on the consumer to make an additional decision as to an appropriate lottery game to select, which is a natural disincentive for the consumer to select a greeting card that is specially adapted for holding a lottery game. The disincentive that arises due to the requirement for the additional decision on the part of the consumer is highlighted by the difficulty that many consumers experience with even selecting a desired greeting card for a given occasion. As a result, the excessive effort that is required to both select a greeting card that is specially adapted for holding a lottery game and to select an appropriate lottery game to include with the greeting card tends to drive consumers to purchase traditional greeting cards (i.e., those not adapted to hold a lottery game).

Despite the past inability of the entities that administer lottery games to successfully provide a greeting card and lottery game combination, there is a strong desire to provide a method of administering a greeting card and lottery game combination that overcomes the aforementioned obstacles due to the strong market potential for such greeting card and lottery game combinations and due to the additional revenue that could be generated from sale of the greeting cards themselves, in addition to revenue generated from the lottery games. In particular, there remains an opportunity to provide a method and system for administering a greeting card and lottery game combination that enables the greeting card to be seamlessly incorporated into traditional environments that are accessible to the consumer without compromising the secure nature of the lottery game such that the consumer does not have to change purchasing habits for purposes of selecting the combined greeting card and lottery game. There further remains an opportunity to provide a method and system for administering a greeting card and lottery game combination that may be capable of achieving an integrated appearance of the greeting card and lottery game combination. There further remains an opportunity to provide a method and system for administering a greeting card and lottery game combination that reduces a burden on the consumer to select an appropriate lottery game to include with a selected greeting card.

SUMMARY OF THE INVENTION AND ADVANTAGES

The instant invention provides a method and a system for administering a greeting card and lottery game combination. The method includes the step of providing the greeting card with an identifier associated therewith. The greeting card is provided at a location accessible to a consumer. A lottery game is maintained at a secure point of sale separate from the greeting card. A vendor of the lottery game obtains information from the identifier associated with the greeting card, which identifier contains sufficient information for the vendor to select the lottery game absent instruction from the consumer, and the lottery game is selected by the vendor based upon the information obtained from the identifier. The selected lottery game is provided to the consumer to produce the greeting card and lottery game combination.

The combined greeting card and lottery game system comprises the greeting card and the lottery game. The lottery game is maintained separate from the greeting card until purchase of the lottery game by the consumer. The greeting card includes the identifier that contains sufficient information for the vendor to select the lottery game absent instruction from the consumer.

The method and system of the instant invention provide numerous advantages over existing greeting card and lottery game combinations. In particular, the method and system of the instant invention enables the greeting card to be seamlessly incorporated into traditional environments that are accessible to the consumer, such as customary greeting card display locations, without compromising the secure nature of the lottery game such that the consumer does not have to change purchasing habits for purposes of selecting the combined greeting card and lottery game. The method and system of the instant invention also enables the entity that is administering the lottery game to control and monitor the greeting card and lottery game combination. With the identifier associated with the greeting card containing sufficient information for the vendor to select the lottery game absent information from the consumer, the appropriate lottery game to include with the greeting card is effectively pre-determined and the greeting card and lottery game combination reduces a burden on the consumer to select the appropriate lottery game to include with the selected greeting card. The greeting card and lottery game combination of the instant invention may also be capable of achieving an integrated appearance due to the fact that the appropriate lottery game to include with the greeting card is effectively pre-determined. The method and system of the instant invention also enables greeting cards, prior to selection by the consumer, to remain useful until selection by the consumer, thereby avoiding waste that may otherwise occur should the greeting card be integrated with the lottery game prior to selection of the greeting card by the consumer and should the lottery game be designed to expire after a set period of time (particularly when the lottery game is a periodic number drawing).

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

A combined greeting card and lottery game system in accordance with the instant invention includes a greeting card and a lottery game. The lottery game is maintained separate from the greeting card, typically until purchase of the lottery game by a consumer. The greeting card is associated with an identifier that contains sufficient information for a vendor to select the lottery game absent instruction from the consumer once the vendor obtains the information from the identifier. More specifically, the identifier associated with the greeting card may be utilized by the vendor to identify and select the appropriate lottery game that is effectively pre-determined to correlate to the greeting card, thereby achieving the same benefits of having a combined greeting card and lottery game that is integrated prior to supplying vendors with the lottery game while maintaining the security of the lottery game and while seamlessly incorporating the combined greeting card into traditional environments that are accessible to the consumer.

As used herein, "entity that is administering the lottery game" refers to the government or business authority that is responsible for honoring winnings associated with the lottery game. As also used herein, "vendor" refers to the party that is designated or approved by the entity that is administering the lottery game to handle official sale of the lottery game to consumers. The vendor is ultimately responsible for payment of the proceeds from the sale of the lottery game to the entity that is administering the lottery game. The vendor may be a lottery retailer such as a convenience store, gas station, pharmacy, etc. Alternatively, the vendor may operate through an electronic device, such as an electronic kiosk situated within a business such as a grocery store or a remote system such as an Internet website that conducts the sale of the lottery game to the consumer through a personal computer with a connection to the Internet. It is to be appreciated that the entity that is administering the lottery game and the vendor may be one in the same. For example, the entity that is administering the lottery game may also operate the aforementioned Internet website. As also used herein, "consumer" refers to the party that is purchasing the lottery game from the vendor for personal use or for purposes of transferring the lottery game to another for personal use.

Figure 1:
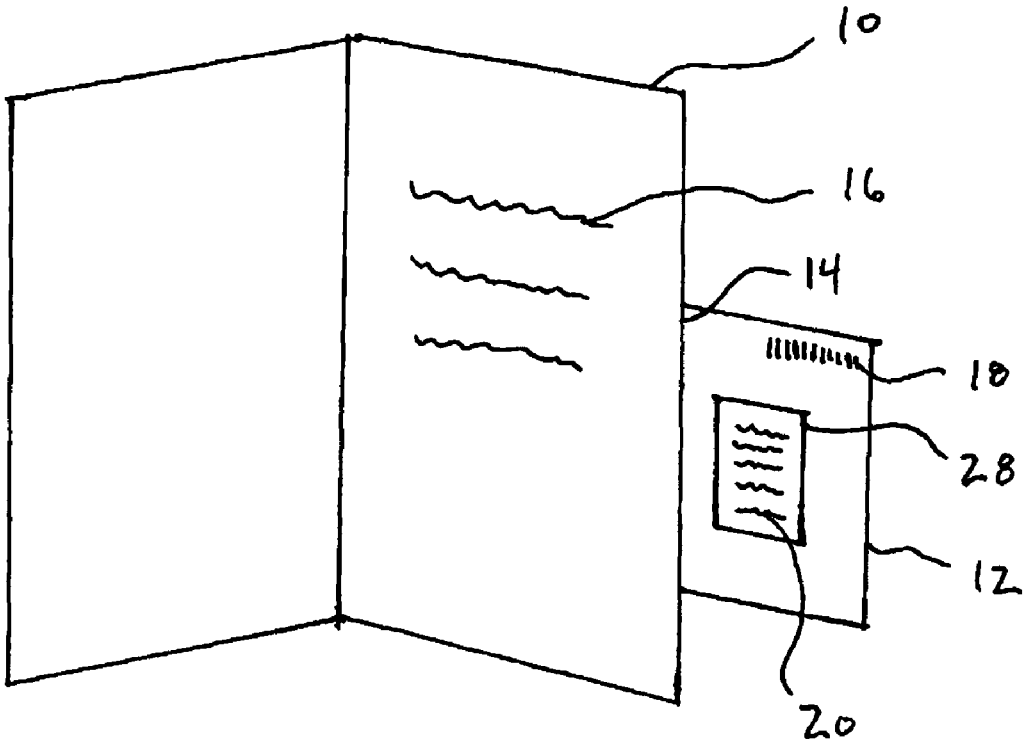
FIG. 1 is a schematic representation of one embodiment of a greeting card suitable for use in the method and system of the instant invention.

The greeting card itself may be a conventional greeting card and may be in any form used for conventional greeting cards. The term "greeting card", as used herein, refers to a medium (which may be in physical or electronic form) bearing a message of greeting, congratulation, or other sentiment intended for communication from one person to another. Typically the greeting cards are in the form of, but are not limited to, bi- or multi-folding paperstock cards. Referring to FIG. 1, the greeting card 10 may include a removable portion 12, such as a flap, that is adapted to receive the lottery game 20 and that is designed for separation from the greeting card. For example, when the removable portion 12 is the flap, the flap is separated from the rest of the greeting card 10 by a perforated hinge 14. The perforated hinge 14 allows separation of the flap including the lottery game 20 from the rest of the greeting card for purposes of preserving the lottery game 20 without the burden of preserving the entire greeting card 10. As another example, the removable portion may be adhered to the greeting card 10 with an adhesive (not shown). As another example, the removable portion may be seated within a slot (not shown) defined by the greeting card 10, thereby allowing the removable portion to be slid in and out of the slot. In this example, the removable portion may be a sheet of material that is configured in shape and/or design to integrate into the particular configuration of the greeting card 10 such that the final greeting card 10 including the lottery game 20 has an integrated appearance.

Referring again to FIG. 1, the greeting card 10 also includes the message 16 thereon. The message 16 may be in the form of words, images, designs, and combinations thereof. The message 16 on the greeting card 10 may have a theme that is tailored to a particular lottery game 20 to which the greeting card 10 is pre-determined to correlate.

As represented schematically in FIG. 1, the identifier 18 may be any symbol, code, or device that is associated with the greeting card 10 and that enables the identification of a particular lottery game 20 that is pre-determined to correlate to the greeting card 10 absent information from the consumer. The identifier 18 is typically disposed in or on the greeting card 10 when the greeting card 10 is in the form of the physical medium. Alternatively, when the greeting card is in electronic form (not shown), the identifier may be an electronic tag or code associated with an electronic greeting card, with the tag or code containing the necessary information in a form that can be read by a computer system (such as the computer system shown in FIG. 4) for purposes of selecting the appropriate lottery game based on the information obtained from the identifier.

The identifier contains sufficient information to identify and select the appropriate lottery game in and of itself, as described in further detail below. The identifier may be, for example, a bar code or other machine-readable code or article, such as an RFID chip, a special indicia such as a holographic image, or any other type of mechanism that may be disposed on the greeting card and used to identify, and optionally verify the authenticity of, the appropriate lottery game that is pre-determined to correlate to the selected greeting card. Alternatively, the identifier may be a specially-printed background located in the region of the greeting card that is adapted to receive the lottery game. Typically, the identifier is a bar code or other machine-readable code or article, which enables matching of the greeting card to an appropriate lottery game.

The identifier is typically disposed on a portion of the greeting card that remains with the lottery game. For example, as shown in FIG. 1, when the greeting card 10 includes the removable portion 12, the identifier 18 is typically disposed on the removable portion 12 as well to thereby ensure that the identifier 18 remains with the lottery game and available for authenticating the lottery game 20 (if desired) at a later point in time.

Figure 2:
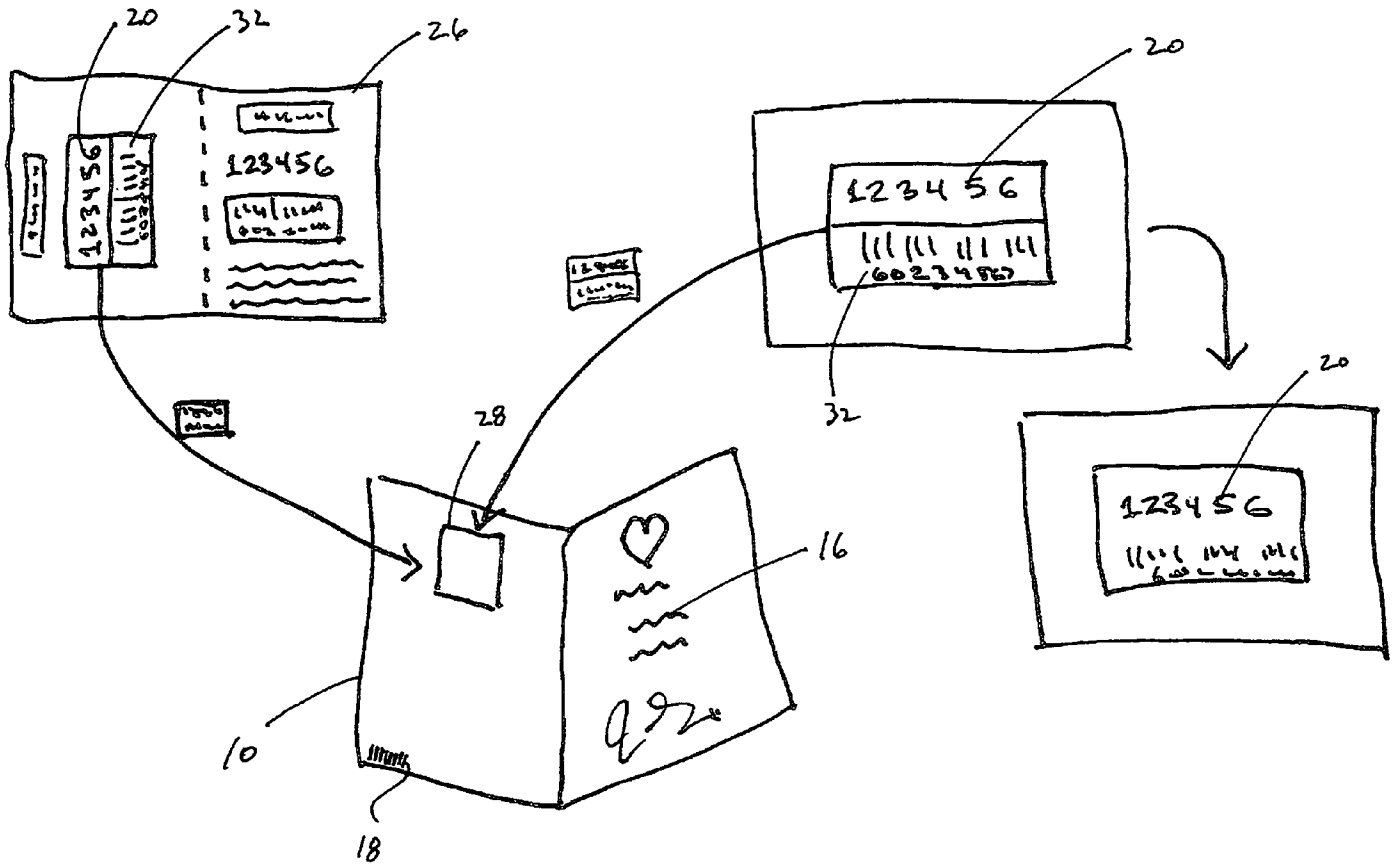
FIG. 2 is a schematic representation of one embodiment of the method of administering a greeting card and lottery game combination in accordance with the instant invention.

As used herein, "lottery game" refers to a physical representation of a contest or game that is provided to the consumer as evidence of the paid-up right to participate in the contest or game, as shown at 20 in FIG. 1. There is no limit as to the type of lottery game that may be included on the greeting cards. For example, the lottery game may be, but is not limited to, a scratch-off game, a number to be entered into a drawing, symbolic code, or an arrangement of numbers or symbolic codes (such as a keno game or bingo-type game), a bar code or other scannable or machine-readable code that is used in conjunction with a scanner or other code-reading device to determine whether or not the code is a winning code, etc. The lottery game is typically provided with conventional types of security indicia and/or anti-counterfeiting features to prevent counterfeiting of the lottery game itself. Additionally, as shown in FIG. 2, the security indicia 32 can be a bar code that accompanies the lottery game. As set forth in further detail below, while the lottery game may have a set monetary denomination, the monetary denomination may be unassigned, with the consumer possessing the ability to set the monetary denomination of the lottery game. When the lottery game is a number to be entered into a drawing, the drawing can be themed in the same manner as the lottery game and/or the greeting card, e.g., the drawing can be themed as a birthday drawing, a holiday drawing such as a New Year's drawing, or other theme that may be correlated to a them of the greeting card that is associated with the lottery game. The drawings can be organized to occur periodically, such as monthly, bi-annually, annually, etc. The frequency of the drawing may depend upon the theme of the drawing.

Figure 4:
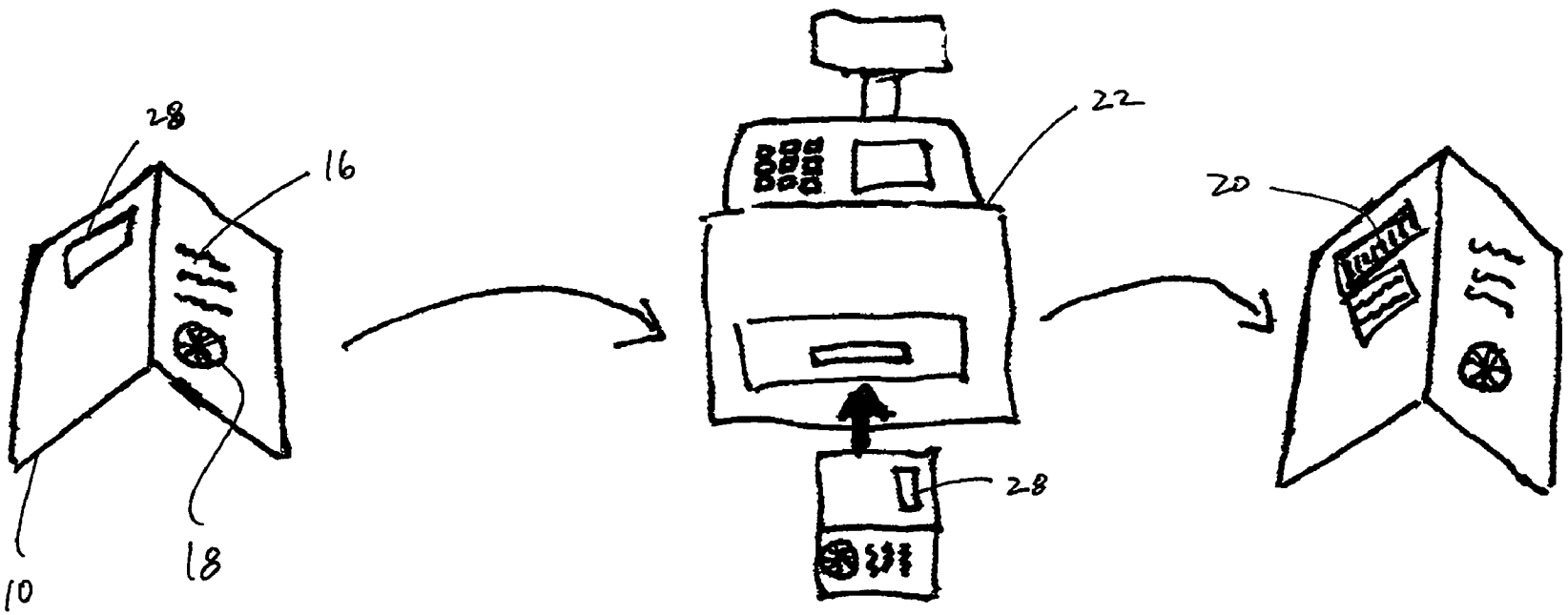
FIG. 4 is a schematic representation of another embodiment of the method of administering a greeting card and lottery game combination in accordance with the instant invention.

In one embodiment, as shown in FIG. 4, the combined greeting card and lottery game system further comprises the computer system 22. The computer system 22 may be utilized to aid in the selection of the appropriate lottery game based on the information obtained from the identifier associated with the greeting card. In fact, the computer system 22 may be used for selecting the lottery game itself based upon the information obtained from the identifier. The particular manner in which the computer system 22 may be used is described below in further detail in the context of the method of the instant invention.

A method for administering a greeting card and lottery game combination in accordance with the instant invention includes the step of providing the greeting card with the identifier associated therewith. More specifically, the greeting card with the identifier associated therewith is provided at a location that is accessible to the consumer. By "location that is accessible to the consumer", it is meant a location in which the consumer is free to handle the greeting card (if the greeting card is in the form of the physical medium) or at least observe the content of the greeting card including details on the inside and/or outside of the greeting card (such as when the greeting card is in electronic form). For example, in one embodiment, the greeting card is displayed on a greeting card display rack with other greeting cards, i.e. conventional greeting cards, thus placing the greeting card in a traditional environment for greeting cards that is accessible to consumers and making the greeting card available for perusal and selection, which leaves the consumer's purchasing experience unchanged from the purchase of conventional greeting cards. In another embodiment, the greeting card is displayed in electronic form on a computer screen, which may be a personal computer or an electronic kiosk located within a business such as a grocery store and with capability provided to view, optionally customize, and print or otherwise provide the selected greeting card to the consumer. As such, it is to be appreciated that the instant invention is not limited to the particular time or place at which the message or image is printed on the greeting card. For example, it is possible that the message or image printed on the greeting card may be printed at a point of sale or at a remote location from the vendor making the sale of the greeting card.

In one embodiment, the greeting card with the identifier associated therewith may be produced by the entity that is administering the lottery game, with the greeting card provided to vendors who also sell the lottery game. Alternatively, the greeting card may be provided to vendors that do not sell the lottery game, with the burden upon the consumer purchasing the greeting card to present the greeting card to a vendor that does sell the lottery game. Alternatively, the greeting card with the identifier associated therewith may be produced by a third party for providing to the vendor. Alternatively, the greeting card with the identifier associated therewith may be produced, in physical form, at an electronic kiosk situated within a business such as a grocery store to thereby provide the greeting card with the identifier associated therewith. Alternatively still, the greeting card with the identifier associated therewith may be produced on a personal printer that is electronically connected to a personal computer to thereby provide the greeting card to the consumer, or the greeting card may be produced by a remote system such as an Internet website to thereby electronically provide the greeting card to the consumer.

The method of the instant invention further includes the step of maintaining the lottery game at a secure point of sale separate from the greeting card, typically until the consumer purchases the lottery game. By "secure point of sale", it is meant a location, either physical or electronic, that hinders transfer of possession of the lottery game to the consumer without authorization from the vendor. Typically, the lottery game is maintained with additional different lottery games at the point of sale. The lottery game is maintained separate from the greeting card for purposes of enabling free handling of the greeting card without compromising the security of the lottery game itself. The lottery game is also maintained separate from the greeting card for purposes of enabling the greeting card to remain valid and useful in the event that the contest embodied by the lottery game is configured to expire after a certain date (such as when the lottery game is a number that represents an entry in a drawing). It is to be appreciated that, within the context of the instant invention, it is also possible to maintain the greeting card at the secure point of sale with the greeting card at the same physical location while still maintaining the lottery game separate from the greeting card and while providing the greeting card at the location that is accessible to the consumer. However, the greeting card is typically displayed on a greeting card display rack with conventional greeting cards for purposes of placing the greeting card in a traditional environment for greeting cards that is accessible to consumers.

The method of the instant invention further includes the step of obtaining information from the identifier associated with the greeting card. The step of obtaining the information typically occurs at the point of sale; however, it is to be appreciated that the step of obtaining the information from the identifier may be performed outside of the point of sale, such as at a physically-located point between the greeting card display rack and the point of sale, or electronically in the computer system prior to commencing the transaction to complete the sale of the lottery game. However, it is the vendor of the lottery game that obtains the information from the identifier for purposes of the method of the instant invention. While the consumer is not necessarily barred from obtaining the information from the identifier associated with the greeting card, the vendor is the party that selects the appropriate lottery game (in a step to be described in further detail below) based on the information obtained from the identifier and, thus, must obtain the information from the identifier at a point in time prior to selecting the lottery game.

The manner in which the vendor obtains the information from the identifier may be dependent upon the type of identifier used. For example, when the identifier is machine-readable, such as a bar code or other machine-readable code or device, such as an RFID chip, the information may be obtained by the vendor using a code reader such as a bar code reader or other type of machine that is adapted to read the machine-readable code or device. More specifically, in this embodiment, the step of identifying the greeting card comprises reading the identifier with the code reader. Also in this embodiment, the code reader may signal the computer system with the information read from the identifier (in which case the computer system is considered an extension of the vendor). Alternatively, when the identifier is a special indicia or a specially-printed background, the vendor or its staff may visually obtain the necessary information from the identifier. Alternatively still, the identifier may be an electronic tag or code associated with the greeting card when the greeting card is in the electronic form or when the greeting card is displayed to the consumer in electronic form prior to printing as described above, with the tag or code containing the necessary information in a form that can be read by the computer system for purposes of selecting the appropriate lottery game based on the information obtained from the identifier.

The method of the instant invention further includes the step of selecting the lottery game based upon the information obtained from the identifier. More specifically, the vendor selects the lottery game at the point of sale based on the information obtained from the identifier associated with the greeting card. Because the identifier enables the vendor to select the appropriate lottery game in the absence of instruction from the consumer, the lottery game itself is effectively pre-determined based upon the information contained in the identifier. The identifier enables the vendor to "match" the appropriate lottery game with the greeting card that includes the identifier, thereby providing controllability of the lottery game and enabling the entity that is administering the lottery game to limit the types of greeting cards with which the lottery game can be appropriately matched. Because the appropriate lottery game is pre-determined for a given greeting card, a theme for the greeting card and the lottery game may be designed in a manner that enables seamless matching such that the greeting card and the lottery game may appear as a single integrated product that reflects such design.

In the embodiment in which the code reader signals the computer system with the information from the identifier, the step of selecting the lottery game may occur within the computer system. In this embodiment, the computer system may signal a device, such as a printer, to provide the lottery game, e.g., by printing the lottery game with the printer. Alternatively, the computer system may display information relative to the selected lottery game on a display screen, with the vendor or its staff then taking physical steps to select the appropriate lottery game from a secure location at the point of sale. Alternatively, the vendor may select the lottery game based on the information obtained from the identifier in the absence of aid from the computer system. For example, the identifier may be the special indicia, such as a state seal, with the vendor or its staff possessing knowledge that a particular lottery game is to be selected for greeting cards with the identifier associated therewith. In embodiments in which the vendor is the electronic device, the information obtained from the identifier, which may be the tag or code associated with the greeting card in electronic form, may be used to select the appropriate lottery game. Use of automated selection of the appropriate lottery game by the electronic device or by the code reader/computer system may further increase the robustness of the instant method by providing an added level of security, thereby reducing human error resulting in mismatching of lottery games to greeting cards, and maintaining authentication tools that prevent fraud.

In one embodiment, as alluded to above, a monetary denomination for the lottery game is pre-set. As also alluded to above, in another embodiment, the monetary denomination of the lottery game may be unassigned at the time of selecting the lottery game based upon the information obtained from the identifier. In this embodiment, the method of the instant invention further comprises the step of selecting a monetary denomination for the lottery game. The identifier associated with the greeting card may contain sufficient information to identify the monetary denomination of the lottery game. Alternatively, the monetary denomination for the lottery game may be selected by the consumer at the point of sale. Selection of a monetary denomination for the lottery game is less tedious than selecting an appropriate lottery game to match a particular greeting card, thereby imparting a minimal burden on the consumer. In fact, it may be preferred by the consumer to select the monetary denomination at the point of sale due to the fact that a pre-set monetary denomination based on the identifier associated with the greeting card may require display of multiple greeting cards that are identical but for different pre-set monetary denominations. Display of multiple greeting cards that differ only in monetary denomination may place an added burden on the consumer to search for a greeting card having the desired denomination, even after the consumer has selected the desired greeting card. Therefore, selection of the monetary denomination for the greeting card by the consumer at the point of sale remains an option that is within the bounds of the method of the instant invention, even though the lottery game itself is effectively pre-determined based upon the information contained in the identifier.

The method of the instant invention may further comprise the step of logging information relative to the greeting card and lottery game combination in the computer system. More specifically, when the computer system is utilized for the step of obtaining the information from the identifier, the information obtained from the identifier may be logged in the computer system. The step of logging typically requires that the identifier contain individualistic data that enables the individual greeting card to be separately identified within the computer system from every other such greeting card that is logged in the system. When the step of logging is performed, the selected lottery game is also logged in the computer system and associated with the information from the identifier associated with the particular greeting card. The step of logging is typically performed when the identifier associated with the greeting card is a bar code or other mechanism that enables an individual code to be assigned to the greeting card, and when the lottery game itself (or the medium on which the lottery game is printed) further includes a lottery identifier that also enables an individual code to be assigned to the particular lottery game. In one embodiment, the method of the instant invention further comprises the step of activating the selected lottery game within the computer system upon logging information relative to the greeting card and lottery game combination therein. In this manner, the entity administering the lottery game and, optionally, the vendor, may conclusively determine whether or not the greeting card and lottery game combination was properly sold and logged in to the computer system, thereby providing another tool for the authenticating the lottery game at issue and detecting fraud. It is to be appreciated that other anti-fraud measures may be taken in the other embodiments as well. For example, when the number is provided from the device based on signals from the computer system at the point of sale, the information may be obtained from the identifier and logged into the computer system in conjunction with the printing of the number to match the number and identifier in the computer system. Such an ability to verify authenticity may be most useful under circumstances in which the lottery game is directly printed upon the greeting card, as opposed to a pre-printed lottery game that is disposed on a separate medium for later integration with the greeting card. In particular, pre-printed lottery games may incorporate elaborate mechanisms such as holographic imaging, whereas lottery games printed directly upon the greeting cards are more limited in printing techniques to those that are available at a point of sale.

After the vendor has selected the lottery game, and after optionally logging the greeting card and lottery game combination in the computer system, the selected lottery game is provided to the consumer to produce the greeting card and lottery game combination. In one embodiment, the step of providing the lottery game is further defined as integrating the lottery game with the greeting card. For example, the step of integrating may be further defined as adhering a medium separate from the greeting card and containing the lottery game onto the greeting card. In the embodiment in which the lottery game is contained on the medium separate from the greeting card, the medium may be physically integrated with the greeting card, typically upon or after purchase of the greeting card. The medium may be a decal that may be adhered to the greeting card through various mechanisms. For example, the decal may be adapted to be heat-bonded onto the greeting card, thereby establishing a permanent bond between the greeting card and the decal. In this embodiment, the greeting card may include a region, coated with a polymer film, that is adapted to heat-bond to the decal including the lottery game. Such heat-bonding typically occurs at the point of sale of the greeting card and is performed by the vendor. It is to be appreciated that conventional adhesives may also be available that sufficiently prevent removal of the decal from the portion of the greeting card to which the decal is adhered. Heat-bonding, as well as use of other adhesives that permanently bond the decal to the portion of the greeting card to which the decal is adhered, may be favorable over other methods of bonding due to an ability to prevent separation of the decal including the lottery game from the portion of the greeting card to which the decal is bonded, which may thereby allow tighter control and authenticability of winning lottery games.

Alternatively, the step of integrating may be further defined as printing the lottery game onto the greeting card. In the embodiment in which the lottery game is printed onto the greeting card, such printing is typically performed at the point of sale, at the time of sale.

In the embodiment in which the lottery game is printed on the medium separate from the greeting card, such as the decal, the lottery game may be pre-printed on the decal (e.g., prior to providing the decal to a merchant) or may be printed on the decal at the point of sale. One specific example of a lottery game that may be pre-printed is a scratch-off lottery game printed on a decal that is adapted to integrate with the greeting card. The medium including the lottery game may then be affixed to the greeting card at the point of sale or may be provided to a consumer to affix at a later point in time. In the embodiment in which the decal is heat-bonded to the greeting card, such heat-bonding is typically performed at the point of sale due to a need for a heating apparatus to perform the heat-bonding. The embodiments in which the lottery game is printed on the medium separate from the greeting card may provide advantages over other embodiments due to an ability to impart the medium separate from the greeting card with anti-fraud features, such as special ink, designs or indicia, watermarks, special paper, etc.

In one embodiment, as shown in FIG. 2, the decal 24 is shown and may further include a separable portion 26 that is intended to be retained by the consumer purchasing the greeting card and lottery game combination. The separable portion 26 may contain linking information to the lottery game purchased, and the linking information may be utilized to provide the consumer with an interest in the potential winnings of the lottery game, even after transfer of the greeting card and lottery game combination to a presumed gifted. Such a feature may serve to provide a further incentive for the consumer to purchase the greeting card and lottery game combination as opposed to a conventional greeting card. As also shown in FIGS. 2 and 3, when the decal 24 is affixed to the greeting card 10 with the adhesive, release paper 34 may be used to maintain the decal until the decal 24 is affixed to the greeting card 10, and the release paper may contain a copy of the lottery game 20 and any anti-counterfeiting feature 32 for purposes of record-keeping on the part of the vendor.

The lottery game may be printed on (for embodiments in which the lottery game is printed directly on the greeting card) or integrated with the greeting card in a pre-designated area designed for receiving the lottery game, thereby enabling an integrated appearance of the lottery game with the greeting card. As alluded to above, the greeting card may have a removable portion that is designed for separation from the greeting card. The pre-designated area may be located on the removable portion of the greeting card.

Figure 3:
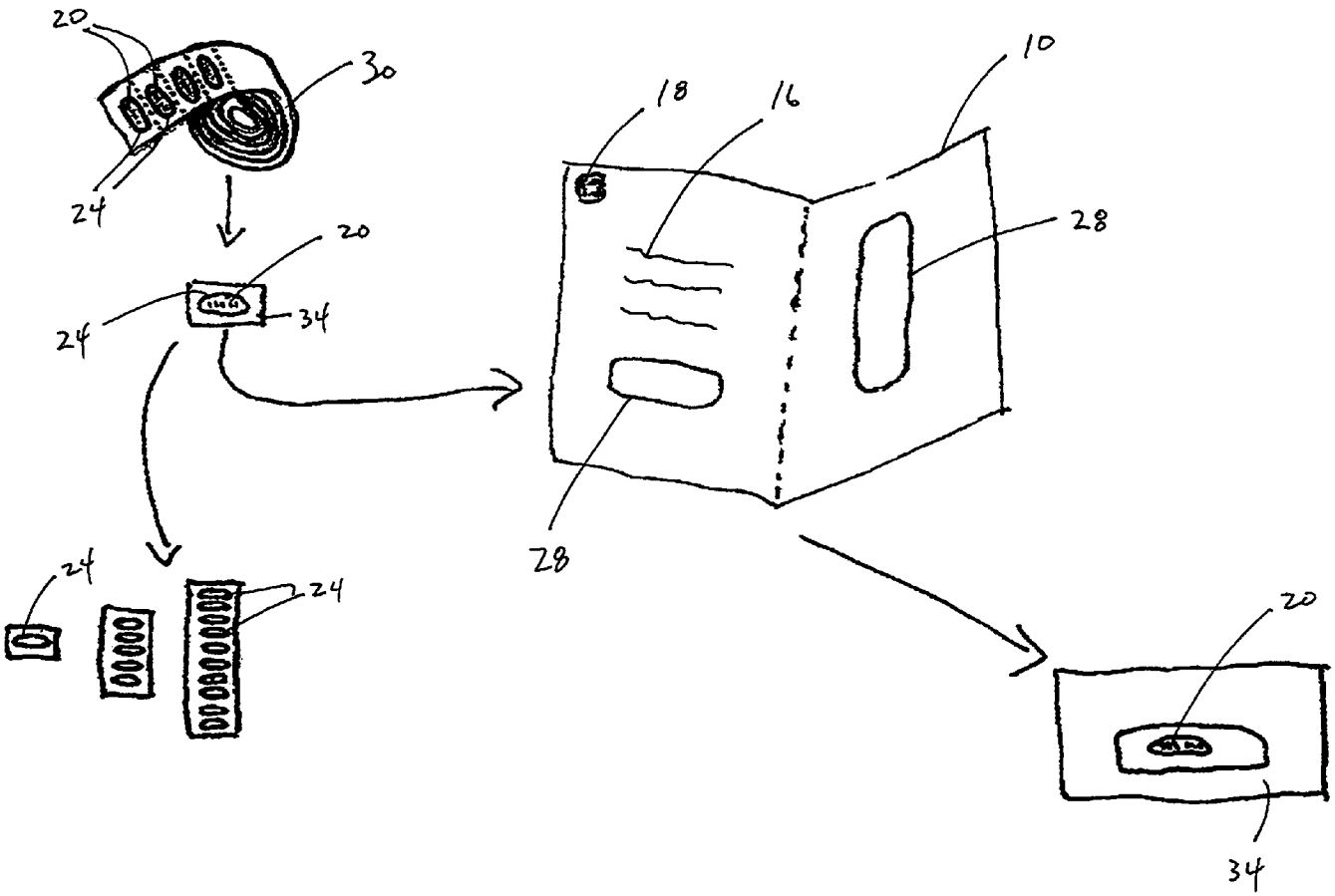
FIG. 3 is a schematic representation of another embodiment of the method of administering a greeting card and lottery game combination in accordance with the instant invention.

Referring to FIG. 3, the greeting cards could potentially be designed with multiple pre-designated areas, or with the pre-designated areas configured in a way to accommodate multiple decals, printed codes, etc. Additionally, the greeting cards may further possess an anti-fraud label to affirm the legitimacy of the greeting card. However, as set forth above, the identifier may serve such anti-counterfeiting purposes itself. When the lottery game is printed directly on the greeting card, the anti-fraud label may be printed on or affixed to the greeting card along with the lottery game. Alternatively, when the lottery game is included on the medium separate from the greeting card, such as the decal, the anti-fraud label may be included on the medium or may be separately printed on the greeting card.

For the embodiments in which the electronic greeting card is used, the lottery game is typically displayed on a computer screen or stored within the computer system with the lottery game integrated therewith. Typically, a visual representation of the identifier is included on the electronic greeting card along with the lottery game. In addition or alternatively to including the visual representation of the identifier on the electronic greeting card, the anti-fraud label may be included on the electronic greeting card. In this manner, the electronic greeting card including the lottery game can be printed by the recipient or by the consumer that creates the electronic greeting card, and the greeting card and lottery game combination may properly include sufficient anti-fraud features.

In one example of the method of the instant invention, as shown in FIGS. 2 and 3, the greeting card 10 is created with the pre-designated area 28 for the decal 24 to be affixed. FIGS. 2 and 3 show variations of this example of the method. The greeting card 10 also includes the identifier 18 printed thereon. Each decal 24 may contain a bar code 32 and/or a number or series of numbers (as shown in FIG. 2). The bar code 32, for purposes of this example, functions as the anti-counterfeiting feature 32 and the numbers 20 function as the lottery game. The bar code and/or number may be pre-printed on the decals 24 or may be printed at the point of sale. Alternatively, the decals 24 may include the bar code pre-printed thereon, with the number or series of numbers printed on the decals 24 at the point of sale. In this manner, the numbers and the bar code may be matched within the computer system, which may be used to verify legitimacy of the lottery game and expose tampering. The decals 24 may be stored in a roll 30 kept at the point of sale, such as behind a store counter or in another secure location, under the supervision of the approved vendor and its staff. The greeting card 10 may be placed on display, such as in the greeting card rack. When a greeting card is purchased, a decal may be affixed by the vendor or its staff, or the decal may be provided to the consumer for affixing on the greeting card themselves. Optionally, the integration of the greeting card and the lottery game may complete validation of the lottery game.

In another embodiment, as shown in FIG. 4, the greeting card 10 is provided in the same manner as in the embodiment shown in FIG. 3. The computer system 22 is provided. The code reader (not shown) may be used in conjunction with the computer system 22. Specifically, the identifier 18 may be machine-readable by the code reader, and the code reader may signal the computer system 22 with the information read from the identifier 18. The computer system 22 may then select the appropriate lottery game 20 and signals a device (not shown) to print, stamp, emboss, etc. the lottery game 20 onto the greeting card 10. Alternatively, the code reader may be omitted and the vendor or its staff may enter information into the computer system 22 based on the identifier 18, whereby the computer system signals the device to print, stamp, emboss, etc. the lottery game 20 onto the greeting card 10

Obviously, many modifications and variations of the present invention are possible in light of the above teachings, and the invention may be practiced otherwise than as specifically described within the scope of the appended claims.

What is claimed is:

1. A method for administering a greeting card and lottery game combination, said method comprising the steps of:

providing the greeting card with an identifier associated therewith at a location accessible to a consumer, wherein the identifier is machine-readable by a code reader;

maintaining a scratch-off lottery game at a secure point of sale separate from the greeting card;

obtaining information from the identifier associated with the greeting card at the point of sale by reading the identifier with the code reader;

selecting the scratch-off lottery game based upon the information obtained from the identifier, providing the selected scratch-off lottery game to the consumer to produce the greeting card and lottery game combination;

wherein a vendor of the scratch-off lottery game obtains the information from the identifier and selects the scratch-off lottery game at the point of sale, and wherein the identifier contains sufficient information for the vendor to select the scratch-off lottery game absent instruction from the consumer; and integrating the scratch-off lottery game with the greeting card after the vendor selects the scratch-off lottery game at the point of sale by adhering a medium containing the scratch-off lottery game onto the greeting card, wherein the integration includes the exchange of the scratch-off lottery game to the consumer.

2. A method as set forth in claim 1 wherein the code reader signals a computer system with the information read from the identifier.

3. A method as set forth in claim 2 wherein the step of selecting the scratch-off lottery game occurs within the computer system.

4. A method as set forth in claim 3 wherein the computer system signals a device to provide the scratch-off lottery game.

5. A method as set forth in claim 3 wherein the computer system displays information relative to the selected scratch-off lottery game on a display screen.

6. A method as set forth in claim 2 further comprising the step of logging the greeting card and lottery game combination in the computer system.

7. A method as set forth in claim 6 further comprising the step of activating the selected scratch-off lottery game within the computer system upon logging the greeting card and lottery game combination therein.

8. A method as set forth in claim 1 wherein the greeting card is displayed on a greeting card display rack with other greeting cards.

9. A method as set forth in claim 1 wherein the greeting card is displayed in electronic form on a computer screen.

10. A method as set forth in claim 1 further comprising the step of selecting a monetary denomination for the scratch-off lottery game.

11. A method as set forth in claim 10 wherein the monetary denomination for the scratch-off lottery game is selected by the consumer at the point of sale.

12. A method as set forth in claim 1 wherein a monetary denomination for the scratch-off lottery game is pre-set.

13. A method as set forth in claim 1 wherein additional different scratch-off lottery games are maintained with the scratch-off lottery game at the secure point of sale.

14. A method for administering a greeting card and lottery game combination, said method comprising the steps of:

providing the greeting card with an identifier associated therewith at a location accessible to a consumer, wherein the identifier is machine-readable by a code reader;

maintaining a scratch-off lottery game at a secure point of sale separate from the greeting card, wherein the scratch-off lottery game is printed on a medium separate from the greeting card and wherein the medium includes a separable portion containing linking information to the scratch-off lottery game purchased;

obtaining information from the identifier associated with the greeting card at the point of sale by reading the identifier with the code reader;

selecting the scratch-off lottery game based upon the information obtained from the identifier;

providing the selected scratch-off lottery game to the consumer to produce the greeting card and lottery game combination;

wherein a vendor of the scratch-off lottery game obtains the information from the identifier and selects the scratch-off lottery game at the point of sale, and wherein the identifier contains sufficient information for the vendor to select the scratch-off lottery game absent instruction from the consumer; and integrating the scratch-off lottery game with the greeting card after the vendor selects the scratch-off lottery game at the point of sale by adhering the medium containing the scratch-off lottery game onto the greeting card, wherein the integration includes the exchange of the scratch-off lottery game to the consumer.

15. A method as set forth in claim 14 wherein the linking information provides an interest in the potential winnings of the scratch-off lottery game to the holder of the separable portion even after transfer of the greeting card and lottery game combination.

* * * * *